United States Patent [19]

Conroy et al.

[11] Patent Number: 4,766,444

[45] Date of Patent: Aug. 23, 1988

[54] CONFORMAL CAVITY-LESS INTERFEROMETER ARRAY

[75] Inventors: Peter J. Conroy, Clarksville; Ronald A. Marino, Laurel, both of Md.

[73] Assignee: Litton Systems, Inc., Little Falls, N.J.

[21] Appl. No.: 880,712

[22] Filed: Jul. 1, 1986

[51] Int. Cl.[4] ..... H01Q 1/36

[52] U.S. Cl. ..... 343/895; 343/700 MS File; 343/844; 343/867

[58] Field of Search ... 343/895, 844, 867, 700 MS File, 343/705, 708

[56] References Cited

U.S. PATENT DOCUMENTS

| | | | |
|---|---|---|---|
| 3,005,986 | 10/1961 | Reed | 343/708 |
| 3,781,898 | 12/1973 | Holloway | 343/895 |
| 4,143,380 | 3/1979 | Kyle | 343/895 |
| 4,319,248 | 3/1982 | Flam | 343/895 |
| 4,368,472 | 1/1983 | Gandhi | 343/895 |
| 4,459,596 | 7/1984 | Flam | 343/895 |
| 4,477,813 | 10/1984 | Weiss | 343/700 MS File |
| 4,636,802 | 1/1987 | Middleton | 343/895 |

*Primary Examiner*—William L. Sikes
*Assistant Examiner*—Hoanganh Le
*Attorney, Agent, or Firm*—Poms, Smith, Lande & Rose

[57] ABSTRACT

An interferometer spiral antennae array having a deformable cavity-less spacer which can be shaped to a nonplanar surface without distorting the alignment of the spiral antennae or increasing the difficulty of aligning Alignment is increased by mounting the spiral antennae the antennae. The accuracy of antennae on a stratum, separate from a ground plane by the deformable spacer. The spiral antennae are electrically connected to RF components on a stripline or microstrip feed/balun circuit board by integral finger-like extensions of the circuit, extending through the ground plane and the deformable spacer, thereby eliminating the need for connectors or cables.

39 Claims, 1 Drawing Sheet

CONFORMAL CAVITY-LESS INTERFEROMETER ARRAY

FIELD OF THE INVENTION

This invention relates to an antennae array and more particularly to an interferometer antennae array.

BACKGROUND OF THE INVENTION

An interferometer is an apparatus that shows interference between two or more wave trains coming from the same source and that compares wavelengths with measurable displacements of reflection. A interferometer antennae array has many applications. For example, it can be used to determine the aximuth of a distant electromagnetic source by comparing the signal phases at the output terminals of two or more antennae receiving a common signal from that source.

Previous interferometer antennae have used a flat plate array. There are two common types of flat plate arrays. One uses a single array assembly and the other, discrete elements. The latter type of flat plate array consists of a heavy structure with accurately spaced cylindrical holes. The holes are lined with metal rings length of the structure and rings, respectively, are of a specified multiple fraction of a wavelength. This assemblage is placed on a ground plane which has apertures, corresponding to the cylindrical holes for the electrical connections, e.g. connectors and cables.

The interferometer antennae which has a flat plate array that utilizes discrete elements can be suitably mounted on any flat or planar surface. The problem with this type of array is that it can not conform to a nonplanar surface. Shaping this array around a nonplanar surface misaligns the holes by distorting the required spacing between them. Also, the rotational alignment between paired antennae is thrown off. For a flat plate array utilizing discrete elements, rotational alignment between paired antennae is accomplished by rotating each spiral antennae until they are "clocked" electrically, aligining the signal phases. So even if the mounting structure is first conformed to a nonplanar surface, the difficulty of aligning paired antennae is compounded.

Accordingly, the principal object of the present invention is to enable an interferometer antennae array to be conformally shaped to a nonplanar surface, e.g. a cylindrical surface, while maintaining precise mechanical alignment between spiral antennae. Other objects of the invention are to eliminate the cavities formed by the metal rings, to decrease the weight of the groundplane while maintaining its structural rigidity and mechanical alignment, and to simplify the electrical connections.

SUMMARY OF THE INVENTION

In accordance with the present invention, an interferometer antennae having a flat plate array utilizes a single array assembly. The spiral array is etched or mounted on a single piece of dielectric. This mounting method enables precise mechanical alignment of the distance between antennae and their rotational orientation to each other. For instance, the accuracy of mechanical alignment of the rotational orientation of the spiral antennae is in the range of 0.001 inches, and additional accuracy can be obtained in the range of 0.0001 inches utilizing a computer aided design terminal on a 10X scale. By fixing the antennae on a separate surface, the cylindrical cavities in the nondeformable structure of the prior art and the metal rings that form them are needless.

The dielectric surface is flexed to the desired curved shape and placed upon a similarly-formed hex-cell RF-absorbing spacer. The hex-cell spacer and its mounted dielectric surface can be flexed to conform to a nonplanar surface without disturbing the mechanical alignment of the spiral array. Once shaped, the assembly can be easily joined by a laminating process to conform to the nonplanar surface without disturbing the mechanical alignment.

The hex-cell spacer is impregnated with carbon or dipped in carbon to coat the outside and inside of the hex-cells. By impregnating or coating the spacer, the RF is reduced; mutual coupling is reduced, and the edge effects of the ground plane due to discontinuities of metal at the ground plane are reduced. As for the physical characteristics of the spacer, it is a multiple of a fraction of a specific wavelength thickness and is lightweight.

The plane of the spacer contiguous to the spiral array has recessed clearances matched to receive each antennae thereby avoiding electrical short circuits. Passageways concentric to these recesses extend to he opposite side of the spacer. Contiguous to the opposite side of the spacer is a thin metallic ground plane. The ground plane has apertures corresponding to the spacer's passageways. These passageways and apertures comprise a conduit for finger-like extensions of a one-piece feed system. The feed system may be a printed circuit board, for example, which has integral finger-like extensions that are electrically connectable to the spiral antennae.

In accordance with the conformal and cavityless features of the present invention, DC gain at low frequency is increased by 1½ to 2 db while the radar cross section is reduced. Also, in accordance with the one-piece feed system feature of the present invention, connectors and cables are eliminated, thereby simplifying the electrical connection.

BRIEF DESCRIPTION OF THE DRAWINGS

Other objects, features and advantages of the present invention will become readily apparent after careful consideration of the following description and accompanying drawings, wherein.

DETAILED DESCRIPTION OF THE PREFERRED EMBODIMENT

Figure 1:
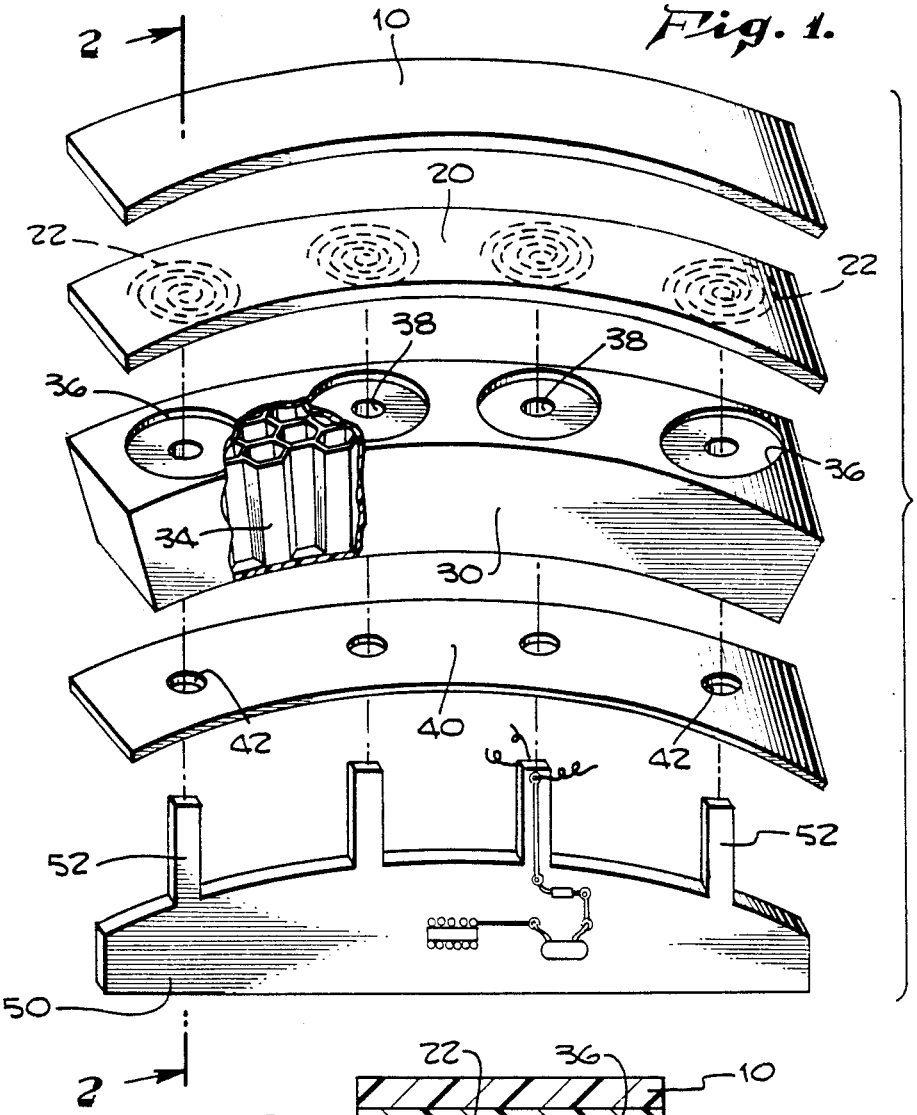
FIG. 1 is an exploded view of an illustrative embodiment of the present invention showing the cover, the spiral antennae array mounted on a dielectric, the hex-cell spacer, the ground plane, and the printed circuit board.

Referring more particularly to the drawings, FIG. 1 shows a preferred embodiment of a conformal spiral interferometer array in an exploded perspective. From top to bottom, FIG. 1 shows a protective cover 10, a dielectric stratum 20, a deformable spacer 30, a ground plane 40, and a printed circuit board 50.

The protective cover 10 covers and protects a conformal spiral interferometer array of antennae 22 from the elements and scratches. The protective cover 10 can be made from any suitable dielectric material. It can be utilized as a mode suppressor or be transparent to all electromagnetic frequencies.

The stratum 20 lies between the protective cover 10 and the deformable spacer 30. The stratum 20 is also made of a suitable dielectric. In FIG. 1, the spiral antennae 22 may be mounted on the upperside of the stratum 20. However, the spiral antennae 22 may also be mounted on the underside, not shown, thus eliminating the need for cover 10. Such antennae mounting may be accomplished by any number of mounting techniques, for example, the spiral antennae 22 may be etched upon element 20. A clear advantage of etching the spiral antennae 22 on the stratum 20, especially if computer aided, is that precise mechanical alignment of the spiral antennae array 22 is obtained. By precise alignment one means their relative rotational orientation and the spatial distance.

FIG. 1 also shows the deformable spacer 30 interposed between the stratum 20 and the ground plane 40. The deformable spacer separates the spiral antennae 22 and the ground plane 40 a preferred embodiment of the present invention contemplates spacing the ground plane 40 a ¼ wavelength from the stratum 20. Implementation of a ¼ wavelength spacing affords minimal interference from reflecting ray waves. The spacing means 30 has a hex-cell structure 34 that may be carbon coated or carbon impregnated. This structure permits the spacing means 30 to be lightweight yet structurally sound. A plurality of counter-sunk apertures 36 below each spiral antennae 22 form recessed clearances between the spiral antennae 22 and the hex-cell structure 34 of the deformable spacer, thereby avoiding the possibility of a short circuit between the ground plane and the spiral antennae 22. Each counter-sunk aperture hole 36 forms a passageway 38 that extends to a complementary aperture 42 in the thin, metallic coated ground plane 40. A plurality of feed through stripline circuit board fingers 52 extending from the printed circuit board 50 through the passageways 38 to provide electrical contact to the spiral antennae 22.

Figure 2:
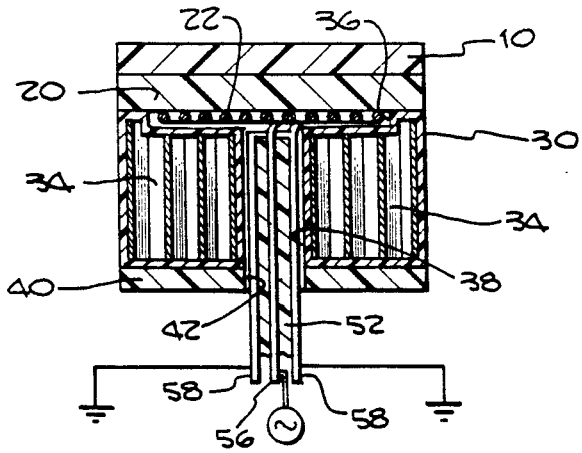
FIG. 2 is a cross-sectional view taken along the line 2—2 of FIG. 1.

The feed through fingers 52 are an integral part of the printed circuit board 50. Each finger 52 may be formed to create a microstrip of stripline feed/balun construction. If a signal carrying element 56 were surrounded by two ground elements 58 (best shown in FIG. 2) a stripline connection to antennae 22 would be formed; while a single carrier 56 and a single ground 58 forms a microstrip connection. The printed circuit board 50 may also mount RF components. Thus, the feed system 50 is a one piece unit that eliminates the need for connectors and cables.

Although the drawings depict the preferred embodiment of the conformal spiral interferometer array contoured to an arcuate surface, the interferometer array can be easily shaped with tooling in the laminating process so that it can be contoured to any nonplanar surface, including but not limited to a cylindrical or spherical surface. Once shaped, heat may be used to set the components into a solid laminated structure.

The laminating process includes but is not limited to the adhesive press process or the vacuum bag process. The adhesive press process consists of using 1–2 millimeters of adhesive between parts, squeezing the parts together; heating the assemblage; and then curing it. The vacuum bag process consists of placing the parts in a container, such as a bag, evacuting the container, thus squeezing the parts together; heating the assemblage; and then curing it.

In the preferred embodiment, the deformable spacing means 30 has a hex-cell structure and is constructed of plastic. While not pictured, it will also be understood by those skilled in the art that other structures could be employed, such as a polycell structure; as well as other materials, such as, fiberglass, epoxy, or other similar dielectrics. It should be emphasized that the present invention is not limited to the apparatus shown in the present drawings and disclosed herein, but that alterations and adaptations may be made such as those discussed hereinabove within the spirit and scope of the invention. Accordingly, the scope of the present invention should be limited only by the following claims.

What is claimed is:

1. A conformal spiral interferometer array, comprising a plurality of spiral antennae rotationally, mechanically aligned;

stratum means for mounting said antennae thereon;

a ground plane situated below said stratum means;

deformable spacing means separating said stratum means from said ground plane;

said spacing means for forming a cavity-less space in close proximity to said antennae between said stratum means and said ground plane; and said stratum means, ground plane and deformable spacing means capable of being conformally shaped to a surface for shaping said antennae.

2. A conformal spiral interferometer array, as claimed in claim 1, further comprising:

said stratum means having an outside surface and mounting said antennae on said outside surface; and protective means for protecting and covering said antennae.

3. A conformal spiral interferometer array, as claimed in claim 1, wherein:

said stratum means is spaced a quarter wavelength from said ground plane.

4. A conformal spiral interferometer array, as claimed in claim 1, wherein:

said spacing means includes a flexible hex-cell structure; and said spacing means is interposed between said stratum means and said ground plane such that it separates said elements by a quarter wavelength.

5. A conformal spiral interferometer array, as claimed in claim 1, wherein:

said spacing means has a width of a quarter wavelength and a plurality of passageways therein.

6. A conformal spiral interferometer array, as claimed in claim 5, wherein:

said plurality of passageways within said spacing means are formed to receive said connecting member and include counter sunk holes to receive said antennae.

7. A conformal spiral interferometer array, as claimed in claim 1, further comprising:

a connecting member comprising a printed circuit board; and said connecting member includes RF components mounted thereon.

8. A conformal spiral interferometer array, as claimed in claim 7, wherein:

said connecting member further includes a plurality of feed through finger means which pass through said deformable spacing means to make electrical connection to said antennae.

9. A conformal spiral interferometer array, as claimed in claim 8, wherein:

said feed through finger means include a microstrip connection formed thereon.

10. A conformal spiral interferometer array, as claimed in claim 8, wherein:

said feed through finger means include a stripline connector formed thereon.

11. A conformal spiral interferometer array, as claimed in claim 1, additionally comprising:

an array capable of being shaped to a nonplanar configuration.

12. A conformal spiral interferometer array, as claimed in claim 11, wherein;

said nonplanar configuration is a cylindrical surface.

13. A conformal spiral interferometer array, as claimed in claim 11, wherein:

said nonplanar configuration is an arcuate surface.

14. A conformal spiral interferometer array, comprising:

a plurality of spiral antennae rotationally, mechanically aligned;

stratum means for mounting said antennae thereon;

a ground plane situated below said stratum means;

deformable spacing means separating said stratum means from said ground plane;

said spacing means forming a cavity-less space in close proximity to said antennae between said stratum means and said ground plane;

a printed circuit board adjacent said ground plane and including a plurality of protruding members passing upward through said spacing means to provide electrical connections to said antennae; and said stratum means, ground plane and deformable spacing means capable of being conformally shaped to a surface for shaping said antennae.

15. A conformal spiral interferometer array, as claimed in claim 14, further comprising:

said stratum means having an outside surface for mounting said antennae thereon; and protective cover means for covering said antennae.

16. A conformal spiral interferometer array, as claimed in claim 14, wherein:

said antennae means is spaced a quarter wavelength from said ground plane.

17. A conformal spiral interferometer array, as claimed in claim 14, wherein:

said spacing means includes a flexible hex-cell structure; and said spacing means is interposed between said stratum and said ground plane such that it separates said elements by a quarter wavelength.

18. A conformal spiral interferometer array, as claimed in claim 14, wherein:

said spacing means has a width of a quarter wavelength and a plurality of passageways therein.

19. A conformal spiral interferometer array, as claimed in claim 18, wherein:

said plurality of passageways within said spacing means are formed to receive said circuit board and include counter sunk holes to receive said antennae.

20. A conformal spiral interferometer array, as claimed in claim 14, wherein:

said circuit board includes RF components mounted thereon.

21. A conformal spiral interferometer array, as claimed in claim 14, wherein:

said plurality of protruding members further includes feed through finger means which pass through said deformable spacing means to make said electrical connection to said antennae.

22. A conformal spiral interferometer array, as claimed in claim 21, wherein:

said circuit board includes a microstrip connection formed thereon.

23. A conformal spiral interferometer array, as claimed in claim 21, wherein:

said circuit board includes a stripline connector formed thereon.

24. A conformal spiral interferometer array, as claimed in claim 14, includes:

an array capable of being shaped to a nonplanar configuration.

25. A conformal spiral interferometer array, as claimed in claim 24, wherein:

said nonplanar configuration is a cylindrical surface.

26. A conformal spiral interferometer array, as claimed in claim 24, wherein:

said nonplanar configuration is an arcuate surface.

27. A conformal cavity-less spiral interferometer array comprising:

a plurality of spiral antennae rotationally, mechanically aligned;

stratum means for mounting said antennae thereon;

a ground plane situated below said stratum means;

deformable spacing means separating said stratum means from said ground plane;

said spacing means forming a cavity-less space in close proximity to said antennae between said stratum means and said ground plane;

a printed circuit board adjacent said ground plane; and an electrical conducting means forming an integral part of said board for making electrical connection to said antennae; and said stratum means, ground plane and deformable spacing means capable of being conformally shaped to a surface for shaping said antennae.

28. A conformal spiral interferometer array, as claimed in claim 27, including:

said stratum means having an outside surface for mounting said antennae thereon; and a protective cover means for protecting and covering said antennae.

29. A conformal spiral interferometer array, as claimed in claim 27, wherein:

said antennae means is spaced a quarter wavelength from said ground plane.

30. A conformal spiral interferometer array, as claimed in claim 27, wherein:

said spacing means includes a flexible hex-cell structure; and said spacing means is interposed between said stratum and said ground plane such that it separates said elements by a quarter wavelength.

31. A conformal spiral interferometer array, as claimed in claim 30, wherein:

said spacing means has a width of a quarter wavelength and a plurality of passageways therein.

32. A conformal spiral interferometer array, as claimed in claim 31, wherein:

said passageways are shaped to receive said electrical conducting means and counter sunk to receive said antennae.

33. A conformal spiral interferometer array, as claimed in claim 27 wherein:

said circuit board includes RF componenets mounted thereon.

34. A conformal spiral interferometer array, as claimed in claim 27, wherein:

said electrical conducting means further includes a plurality of feed through finger means which pass through said deformable spacing means to make said electrical connection to said antennae.

35. A conformal spiral interferometer array, as claimed in claim 19, wherein:

said electrical conducting means include a microstrip connection formed thereon.

36. a conformal spiral interferometer array, as claimed in claim 34, wherein:

said electrical conducting means includes a stripline connection formed thereon.

37. A conformal spiral interferometer array, as claimed in claim 27, includes:

an array capable of being shaped to a non-planer configuration.

38. A conformation spiral interferometer array, as claimed in claim 37, wherein:

said nonplanar configuration is a cylindrical surface.

39. A conformal spiral interferometer array, as claimed in claim 37, wherein:

said nonplanar configuration is an arcuate surface.

* * * * *